US009099016B2

(12) United States Patent
Seda

(10) Patent No.: US 9,099,016 B2
(45) Date of Patent: Aug. 4, 2015

(54) ADVERTISING PANEL

(76) Inventor: Luiz Antonio Seda, Ilha do Governador (BR)

( * ) Notice: Subject to any disclaimer, the term of this patent is extended or adjusted under 35 U.S.C. 154(b) by 0 days.

(21) Appl. No.: 13/375,137

(22) PCT Filed: May 28, 2010

(86) PCT No.: PCT/BR2010/000181

§ 371 (c)(1),
(2), (4) Date: Feb. 10, 2012

(87) PCT Pub. No.: WO2010/135799

PCT Pub. Date: Dec. 2, 2010

(65) Prior Publication Data

US 2012/0124870 A1 May 24, 2012

(30) Foreign Application Priority Data

May 29, 2009 (BR) ..... 0901621

(51) Int. Cl.
*G09F 11/02* (2006.01)
*G09F 11/06* (2006.01)
*G09F 11/30* (2006.01)

(52) U.S. Cl.
CPC ..... *G09F 11/02* (2013.01); *G09F 11/06* (2013.01); *G09F 11/30* (2013.01)

(58) Field of Classification Search
CPC ..... G09F 11/02; G09F 11/06; G09F 11/30
USPC ..... 40/371, 377, 378, 380, 475, 792, 429, 40/430, 436–438, 473, 470
See application file for complete search history.

(56) References Cited

U.S. PATENT DOCUMENTS

| | | | | | |
|---|---|---|---|---|---|
| 1,077,885 | A | * | 11/1913 | La Pearl | 40/505 |
| 3,696,536 | A | * | 10/1972 | Reese et al. | 40/475 |
| 3,755,936 | A | * | 9/1973 | Terre et al. | 40/473 |
| 4,407,084 | A | * | 10/1983 | Uihlein et al. | 40/475 |
| 4,414,767 | A | * | 11/1983 | Staton | 40/429 |
| 4,542,604 | A | * | 9/1985 | Uihlein et al. | 40/475 |
| 4,775,863 | A | | 10/1988 | Jaki et al. | |
| 5,077,923 | A | * | 1/1992 | Rockola et al. | 40/510 |
| 6,249,999 | B1 | * | 6/2001 | Borge et al. | 40/470 |
| 8,302,938 | B2 | * | 11/2012 | Ebeling | 256/59 |
| 2002/0148147 | A1 | * | 10/2002 | Francis | 40/426 |
| 2009/0229151 | A1 | * | 9/2009 | Brown et al. | 40/475 |
| 2010/0146830 | A1 | * | 6/2010 | Large | 40/473 |
| 2012/0124870 | A1 | * | 5/2012 | Seda | 40/473 |

FOREIGN PATENT DOCUMENTS

| | | | |
|---|---|---|---|
| CN | 201302798 | Y | 9/2009 |
| GB | 762611 | A | 11/1956 |

* cited by examiner

*Primary Examiner* — Shin Kim
(74) *Attorney, Agent, or Firm* — Hoglund & Pamias, P.S.C.; Roberto J. Rios

(57) ABSTRACT

The present invention relates to an advertising panel that consists in the use of an assembly of electric connections and electric and electronic components, toothed gears and timers, and to a system for displaying advertising segments in continuous or discontinuous sections which, during rotation, show a whole image, used to present an unlimited number of advertisements in a single system.

5 Claims, 2 Drawing Sheets

ADVERTISING PANEL

Figure 1:
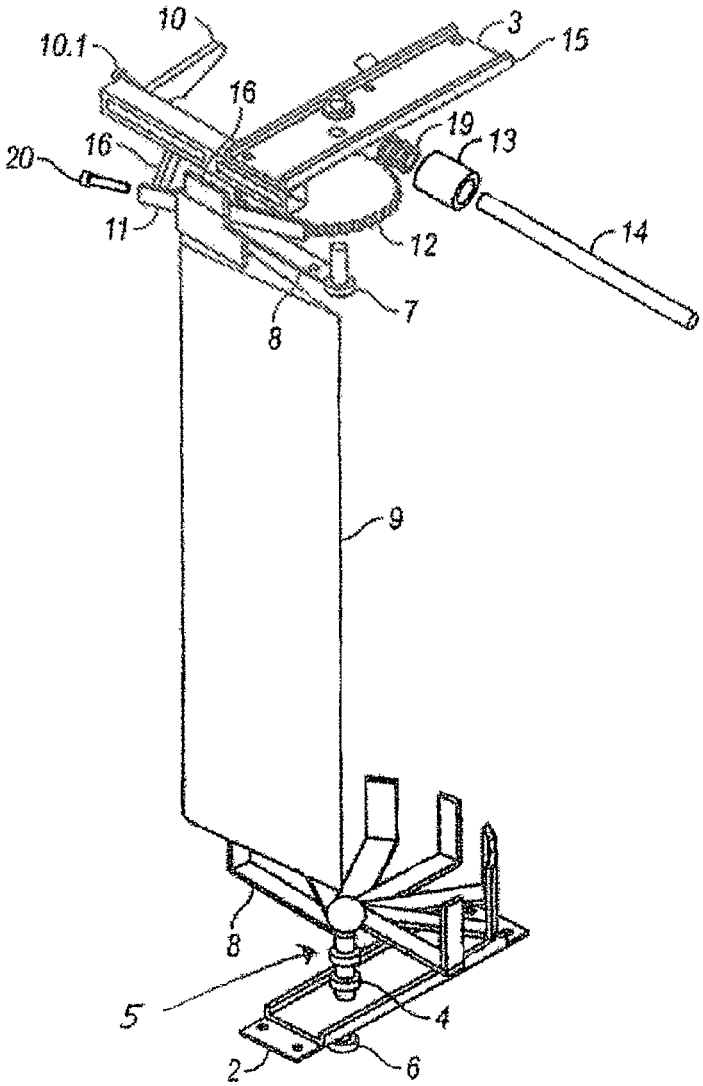

This application is the National State of International Application No. PCT/BR2010/000181, filed May 28, 2010.

Patent of Invention Application that consists in using an assembly of electric connections and electric and electronic components, toothed gears and timers, and of a system for displaying advertising segments in continuous or discontinuous sessions which, during rotation, show a whole image, used to present an unlimited number of advertisements in a single system.

Application Field: Advertising Panel with advertising pieces rotating with turning profiles.

It is known from the state of art advertising panels named trihedrons and presenting images in rolls, all embedded in boxes of varied dimensions and provided with images rotating mechanisms, whether by triangular prisms made-up of a hard material or by printed canvas or plastic mats.

In a search on anteriorities of the object of the claimed Advertising Panel, there have been found some patents that discuss the state of the art developed until today, as follows:

PI8800771 5—ROTARY ELEMENTS MOVING DEVICE, made of vertical, prismatic blocks, which faces receive three advertising messages, said blocks being driven through a stepper motor, which shaft is fastened to a cylindrical part having a flange, wherein a lever is eccentrically fastened and also fastened to an arm interconnected to the wheel parallelly to which another is envisaged, fastened to a gear set; the wheels and are press-held one against the other by an internal spring, the abutting faces of same having equidistant arranged relieves.

PI0317722-0—VISUAL DISPLAY APPARATUS INTENDED FOR IMAGE CHANGING, the present inventions relates to a visual display apparatus intended for image changing. The apparatus comprises a cartridge unit fitted to be replaced as a single unit. The cartridge unit comprises image conveyors in the form of a sheet. The image conveyors comprise image parts that make up at least two different images. The image conveyors are subdivided in panels fitted to mutually slide. Additionally the cartridge unit comprises a back plate that covers one side of one of the image conveyors. Additionally the visual display apparatus comprises a mobile mean to move the different image conveyors in relation to each other, and a frame to lift the cartridge with the image conveyors and the mobile mean. According to the invention, one of the image conveyors is fixedly connected to the back plate over its edges. The back plate is mobile in relation with the frame, and the mobile mean is fitted to move the back plate.

MU8301713-5—FOUR FACES ADVERTISING PANEL, made of a rectangular and horizontally lengthened metallic frame that is interconnected in the lower part to a horizontal bar, the trihedron shaping set being set-up in which structure, said metallic structure frontally and in its lower part presenting a plurality of guide rails wherein the rectangular shaping plates are slidly set-up and with their shuttle movement synchronized with the trihedron, upon a closing position and when overlaying the trihedron, of a curtain that makes an additional panel.

As it can be concluded, said above-noted patents with their abstracts emphasized and transcript do not demonstrate the plurality of images that can be displayed, nor comment in any part in their specification any image insert system in a rotary system that exceed four displayed units.

In order to overcome this market limitation and give a larger visibility and a varied amount of advertising images, there has been developed the "Advertising Panel", comprised of a rotary system of blades that surround a main shaft, said shaft being driven by a motor that in turn is coupled to a timer, which in determined intervals carries about the blades display, at a 180-210 degree angle, said blades printed with advertising beams in their two faces, said beams in whole in determined sections composing a single and complete advertising image. The blades placement that can be done clockwise as well as counterclockwise is provided with a direct current passage system that feeds LEDs to the visualization of adverting images in low light or visibility settings, even at a long distance.

One of its features is that it is an uni-point system that can be used as a complementary process in the industrial production line suitable to any sort of advertising panel, its parts and constitutive pieces are made of injected rigid or semi-rigid plastic, also opaque, translucent or transparent and further metal, aluminum and Methalon, having enough strength related to the intended means.

Exhaustive tests have been done aiming at proving the efficacy of the advertising panel system application. The system has proven to be an economical viable on, and substantially does not burden the final cost of the product, allowing a perfect fit in any industrial assembly line, adding extremely attractive functionalities to the consumer people in general, that is, mainly the advertising pieces visibility in unlimited amounts.

The now-claimed system introduction refers to a display system of advertising blades placed on a central shaft, said system, which needs alternating current, already consecrated in the state of the art and duly commented in the course of the anteriorities mention, which is provided with unlimited quantities of blades about the central shaft, which are longitudinally fastened to said blades side, said central shaft has spaced arranged bolts to the determined amount of exposed blades, which number has display application in larger amounts than the market panels, between three and twenty faces, which limit can be exceeded.

The advertising panel is driven by an AC or DC electric motor with a gearbox and a 220 rpm output that is geared to the shaft and worm with a 1:30 gear down, and has a rotation of 5 to 10 rpm, that is geared to the fishing gear which moves clockwise and counterclockwise in a range of about 210° at always constant time intervals of at about 7 seconds, wherein the rotation direction is defined by two stoppers. In a direction the aluminum blade that contains the aligned images blades is unlocked and fishes the highlighted blade, strikes the stopper and reverts the rotation direction carrying the blade to the other side in a time interval of 210° (7 seconds), a new image profile being made, and close to the final alignment of the image blade the, fishing blade unlocks de blade that was highlighted, pressing it against the highlighted blade until the same stays placed on the final alignment.

In this step, the fishing gear drives the stopper to the return movement of the fishing gear to the gripping position of the next blade to be displayed, and the timer at this time is turned on, which determines the display time of images in each set of aluminum profiles. The timer together with the stoppers forms the on-off assembly on the approximately 180°-210° rotation movement clockwise and counterclockwise of the AC/DC motor.

The advertising panel can be manufactured with a set or sets of three blades or even more images that will be defined according to the blade width. The blade bottom and the clearance between the blades or several blades sets, from three to an unlimited number of images, which can be driven by an AC or DC electric motor that is coupled to a shaft that passes a movement on to the gears through a worm upon a movement of the blade or blades, or by an AC or DC motor that is directly coupled to the blades set thus promoting the same intended effect.

One of the main features of the Advertising Panel application consists on a larger capability of displaying advertising pieces on a blade set by display face, and on the same constructive array has an unlimited set of time-synchronized grouped blades in order to allow the display of the unlimited number of advertising pieces in the same constructive array. The display time of advertising pieces by display face is of at about 7 seconds, and the electric power consumption is extremely low for the functioning of the set mechanical system. The constructive array of the Advertising Panel has a structural tubular profile box made of carbon steel, which profiles are electric welded, receiving a mechanic cleaning with anti-corrosive galvanic-primer protection, galvanized or aluminum sheets laterally covering it, a background closure in vinyl canvas blackout (BO), anti-corrosive application, and a final synthetic enamel finishing. It has Duralumin-made mechanisms, exposure image prisms in extruded aluminum, motor and time mechanism and further has a security seal, which allows the mechanical system integrity.

The advertising panel can be programmed to a continuous and uninterrupted working, or the same can be programmed to work in determined time periods. In places where the noise level is low, the system has sound messages accompanying the displayed advertisement pieces. It has a monitoring system through a cell or conventional telephone line, an alarm that triggers after twenty seconds of image display interruption.

Further, the image display system, when applied to display media, has an image transferring process therefor making use of inks, bases and dyes which properties are thermoset in a die heat transfer process, or not, which pigments have their own luminescence, thus allowing that the Advertising Panel has extremely satisfactory results concerning with the visibility of advertising pieces when displayed on indoors and outdoors settings of low visibility. There is made use also of a blade lighting process through LEDs lights that run all over the side profile of each blade, or a determined blade set or in all the blades thus allowing its visibility. The electric energy transfer so the LEDs can be turned on is done by a direct current, which varies between 6 Volts and 8 Volts, wherein constructive array mechanisms are applied, which interconnect, and touch, or drag, or slide, through a cupper race and a contact brush, all interconnected by an electric wiring system that runs on the blade movement mechanic system where the advertising pieces are applied.

The components that make part of the Advertising Panel are linked and listed as follows: an structure in Methalon, galvanized iron and/or similar materials (1); differentiated design finishes (1.1); a lower chassis, in Methalon, galvanized iron, aluminum or a similar material (2); upper chassis, in Methalon, galvanized iron, aluminum or a similar material (3); lower fastening shaft of blades supports (4); upper fastening shaft of blades supports (5); lower shaft fastening pin (6); upper shaft fastening pin (7); sliding support of aluminum blades (8); aluminum profile blades (9); blade lock (10); blade lock support (10.1); fishing set (11); fishing gear (12); gear driving worm (13); worm driving shaft (14); driving shaft bearing (15); fishing set bait (16); electric/electronic circuit; electric motor(s); bearing bushing (19), fishing set shaft (20); LEDs light turning-on mechanical device, LEDs light turning-on electric device.

The materials used in the constructive array of the pieces that integrate the mechanical system of the Advertising Panel can be extruded, injected, molded in several industrial processes of machining and make use of materials such as aluminum, Duralumin, galvanized iron, Methalon and galvanized sheets; hard plastics and their similar can and should be used.

Figure 2:
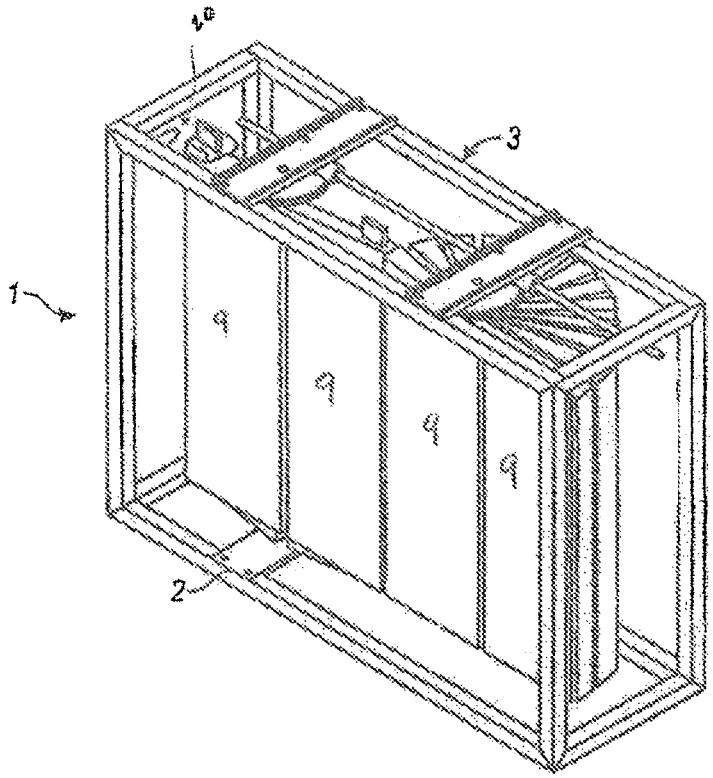

In order to achieve a better visualization of the Advertising Panel there can be done a reference to the FIGS. 1 and 2 drawings, where there are presented an exploded view and an isometric view, respectively, of the components integrating the mechanical system.

The invention claimed is:

1. Advertising panel, comprising: a rotary system of blades that surround a main shaft, said main shaft being driven by a motor that in turn is coupled to a timer, which, in determined intervals, carries about displays of blades, at a 180-210 degrees angle, said blades printed with advertising beams on two faces, said advertising beams in whole in determined sections composing a single and complete advertising image characterized in that it is made of sets of rotary blades from any number of blades between 3 and 20, wherein the number of sets depends on each panel width; wherein each set displays two image segments and all the aligned segments make up the whole image; wherein the set is driven by an AC or DC electric motor with a gearbox that is geared to a shaft and worm with a 1:30 gear down, at about 5 to 10 rpm rotation through a reducing gear drives the horizontal shaft with worms that drives the individual gears of each set; wherein the gears have an arm in which end there is a hook called the fishing set; wherein the arm describes an angle between 180 and 210 degrees until driving the motor reversal; wherein when returning the fishing set turns the blade that was displayed, uncovering the following image; wherein by the end of the course the timer is driven, which, after the programmable time between 7 and 60 seconds, restarts the electronic circuit and initiates a new cycle of exchange of image, wherein the rotation direction is defined by two (02) stoppers.

2. Advertising panel, according to claim 1, characterized in that it propels the fishing gear thus driving a stopper to a return movement of the fishing gear to a gripping position of a next blade to be displayed, and the timer is turned on, which determines a display time of images in each set of aluminum profiles, said timer together with the stoppers forming the on-off assembly on the approximately 180°-210° rotation movement clockwise and counterclockwise of the AC/DC motor.

3. Advertising panel, comprising: a rotary system of blades that surround a main shaft, said main shaft being driven by a motor that in turn is coupled to a timer, which, in determined intervals, carries about displays of blades, at a 180-210 degrees angle, said blades printed with advertising beams on two faces, said advertising beams in whole in determined sections composing a single and complete advertising image characterized in that it is programmed to a continuous working or to work in determined time periods, wherein the images can be complemented by synchronized sound messages and can be monitored through a telephone land line or mobile phone, in order to warn the central office in case of breakdown.

4. Advertising panel, comprising: a rotary system of blades that surround a main shaft, said main shaft being driven by a motor that in turn is coupled to a timer, which, in determined intervals, carries about displays of blades, at a 180-210 degrees angle, said blades printed with advertising beams on two faces, said advertising beams in whole in determined sections composing a single and complete advertising image characterized in that it has the following parts: an structure in metal or plastic structure (1); a lower chassis (2); upper chassis with cross elements having a drilling for mounting the bearings of the horizontal shaft (3); lower fastening shaft of blades supports (4); upper fastening shaft of blades supports (5); lower shaft fastening pin (6); upper shaft fastening pin (7); aluminum supports (8); aluminum profile blades (9); blade lock (10); blade lock support (10.1); fishing set (11); fishing gear (12); gear driving worm (13); worm driving shaft (14); driving shaft bearing (15); fishing set (16); bearing bushing (19), and fishing set shaft (20).

5. An advertising panel, comprising: a rotary system of blades that surround a main shaft, said main shaft being driven by a motor that in turn is coupled to a timer, which, in determined intervals, carries about displays of blades, at a 180-210 degrees angle, said blades printed with advertising beams on two faces, said advertising beams in whole in determined sections composing a single and complete advertising image, characterized in that the advertising panel presents the blades placement clockwise as well as counterclockwise, provided with a direct current passage system that feeds LEDs, is an uni-point system that is used as a complementary process in an industrial production line suitable to advertising panels, the advertising panel's parts and constitutive pieces are made of injected rigid or semi-rigid plastic, also opaque, translucent or transparent and further of metal, aluminum and Methalon;

wherein, the advertising panel has a structure in Methalon, galvanized iron and/or similar materials (1); a lower chassis, in Methalon, galvanized iron, aluminum or a similar material (2); upper chassis, in Methalon, galvanized iron, aluminum or a similar material (3); lower fastening shaft of blades supports (4); upper fastening shaft of blades supports (5); lower shaft fastening pin (6); upper shaft fastening pin (7); sliding support of aluminum blades (8); aluminum profile blades (9); blade lock (10); blade lock support (10.1); fishing set (11); fishing gear (12); gear driving worm (13); worm driving shaft (14); driving shaft bearing (15); fishing set bait (16); electric/electronic circuit; electric motor(s); bearing bushing (19), fishing set shaft (20); LEDs light turning-on mechanical device, LEDs light turning-on electric device.

* * * * *